US011455929B2

(12) United States Patent
Sun et al.

(10) Patent No.: US 11,455,929 B2
(45) Date of Patent: Sep. 27, 2022

(54) DRIVING METHOD AND APPARATUS OF DISPLAY PANEL

(71) Applicants: Beijing BOE Display Technology Co., Ltd., Beijing (CN); BOE Technology Group Co., Ltd., Beijing (CN)

(72) Inventors: Zhihua Sun, Beijing (CN); Yinlong Zhang, Beijing (CN); Senwang Li, Beijing (CN); Yanping Liao, Beijing (CN); Xibin Shao, Beijing (CN); Feng Qu, Beijing (CN)

(73) Assignees: Beijing BOE Display Technology Co., Ltd., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/458,171

(22) Filed: Aug. 26, 2021

(65) Prior Publication Data

US 2022/0122510 A1 Apr. 21, 2022

(30) Foreign Application Priority Data

Oct. 21, 2020 (CN) ..... 202011132344.X

(51) Int. Cl.
*G09G 3/20* (2006.01)

(52) U.S. Cl.
CPC ..... *G09G 3/20* (2013.01); *G09G 2320/0252* (2013.01); *G09G 2340/14* (2013.01)

(58) Field of Classification Search
CPC ..... G09G 3/20; G09G 2320/0252; G09G 2340/14
See application file for complete search history.

(56) References Cited

U.S. PATENT DOCUMENTS

2010/0171725 A1* 7/2010 Tsai ..... G09G 3/20 345/55
2011/0025663 A1* 2/2011 Bae ..... G09G 3/3291 345/82
2011/0221721 A1* 9/2011 Tsou ..... G09G 3/20 345/206
2019/0130816 A1* 5/2019 Qian ..... G09G 3/22

* cited by examiner

*Primary Examiner* — Sejoon Ahn
(74) *Attorney, Agent, or Firm* — IPro, PLLC

(57) ABSTRACT

The present disclosure discloses a driving method and apparatus of a display panel. When the display panel is driven to display a $(2k-1)^{th}$ image, only display data, corresponding to pixels of one row group, in image data of a $k^{th}$ display frame of a plurality of display frames are transmitted to a driver chip in the display panel, and a data size transmitted may be reduced. When the display panel is driven to display a $(2k)^{th}$ image, display data, corresponding to pixels of another row group, in the image data of the $k^{th}$ display frame are transmitted to the driver chip in the display panel, and the data size transmitted may also be reduced.

12 Claims, 3 Drawing Sheets

DRIVING METHOD AND APPARATUS OF DISPLAY PANEL

CROSS REFERENCE TO RELATED APPLICATIONS

The present disclosure claims priority to Chinese Patent Application No. 202011132344.X filed with the China National Intellectual Property Administration on Oct. 21, 2020, the entire contents of which are incorporated herein by its reference.

FIELD

The present disclosure relates to the technical field of display, in particular to a driving method and apparatus of a display panel.

BACKGROUND

In a display panel, such as a liquid crystal display (LCD) and an organic light-emitting diode (OLED) display panel, a plurality of pixels are generally included. Each pixel may include a red sub-pixel, a green sub-pixel, and a blue sub-pixel. By controlling display data corresponding to each sub-pixel, display brightness of each sub-pixel is controlled, so that a desired display color is mixed to display a color image.

SUMMARY

Embodiments of the present disclosure provide a driving method and apparatus of a display panel, used for driving the display panel to display.

According to the driving method of the display panel provided by the embodiment of the present disclosure, the display panel includes a plurality of rows of pixels; the plurality of rows of pixels are divided into N row groups, and each of the row groups includes pixels spaced by N−1 rows; N is an integer greater than 1; and the driving method includes:

obtaining image data of a plurality of continuous display frames to be displayed, wherein image data of each of the display frames includes display data corresponding to each of the pixels;

in a condition that the display panel is driven to display a $(2k-1)^{th}$ image, transmitting display data, corresponding to pixels of one of the row groups, in the image data of a $k^{th}$ display frame of the plurality of display frames to a driver chip in the display panel, so that the driver chip in the display panel drives the display panel to display an image according to the received display data, wherein k is an integer greater than 0; and in a condition that the display panel is driven to display a $(2k)^{th}$ image, transmitting display data, corresponding to pixels of another of the row groups, in the image data of the $k^{th}$ display frame to the driver chip in the display panel, so that the driver chip in the display panel drives the display panel to display an image according to the received display data.

In some examples, N=2, the 2 row groups include a first row group and a second row group, the first row group includes odd-numbered rows of pixels, and the second row group includes even-numbered rows of pixels; and in the condition that the display panel is driven to display the $(2k-1)^{th}$ image, transmitting the display data, corresponding to the pixels of one of the row groups, in the image data of the $k^{th}$ display frame of the plurality of display frames to the driver chip in the display panel includes:

in the condition that the display panel is driven to display the $(2k-1)^{th}$ image, transmitting display data, corresponding to pixels of the first row group, in the image data of the $k^{th}$ display frame to the driver chip in the display panel; or in the condition that the display panel is driven to display the $(2k-1)^{th}$ image, transmitting display data, corresponding to pixels of the second row group, in the image data of the $k^{th}$ display frame to the driver chip in the display panel.

In some examples, N=2, the 2 row groups include a first row group and a second row group, the first row group includes odd-numbered rows of pixels, and the second row group includes even-numbered rows of pixels; and in the condition that the display panel is driven to display the $(2k)^{th}$ image, transmitting the display data, corresponding to the pixels of the another of the row groups, in the image data of the $k^{th}$ display frame to the driver chip in the display panel includes:

in the condition that the display panel is driven to display the $(2k)^{th}$ image, transmitting display data, corresponding to pixels of the second row group, in the image data of the $k^{th}$ display frame to the driver chip in the display panel; or in the condition that the display panel is driven to display the $(2k)^{th}$ image, transmitting display data, corresponding to pixels of the first row group, in the image data of the $k^{th}$ display frame to the driver chip in the display panel.

In some examples, one row of pixels is divided into a plurality of pixel groups, and each of the pixel groups includes at least one pixel; and in the condition that the display data, corresponding to the pixels of the first row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the second row group as data obtained by weighting display data corresponding to an upper row of pixel group and display data corresponding to a lower row of pixel group adjacent to the respective pixel groups in the second row group.

In some examples, the display data corresponding to the respective pixel groups in the second row group are determined as the data obtained by weighting the display data corresponding to the upper row of pixel group and the display data corresponding to the lower row of pixel group adjacent to the respective pixel groups in the second row group according to a formula as follows:

$$D12_{X,Y}=L12_{X,Y}(D12_{X-1,Y}+D12_{X+1,Y});$$

wherein $D12_{X,Y}$ represents display data corresponding to one of the pixel groups in the second row group, $L12_{X,Y}$ represents a weighting parameter corresponding to the one pixel group corresponding to the display data $D12_{X,Y}$, $D12_{X-1,Y}$ represents display data corresponding to an upper row of pixel group adjacent to the one pixel group corresponding to the display data $D12_{X,Y}$, and $D12_{X+1,Y}$ represents display data corresponding to a lower row of pixel group adjacent to the one pixel group corresponding to the display data $D12_{X,Y}$.

In some examples, one row of pixels is divided into a plurality of pixel groups, and each of the pixel groups includes at least one pixel; and in the condition that the display data, corresponding to the pixels of the second row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the first row group as data obtained by weighting display data corresponding to an upper row of pixel group and display data corresponding to a lower row of pixel group adjacent to the respective pixel groups in the first row group.

In some examples, the display data corresponding to the respective pixel groups in the first row group are determined as the data obtained by weighting the display data corresponding to the upper row of pixel group and the display data corresponding to the lower row of pixel group adjacent to the respective pixel groups in the first row group according to a formula as follows:

$$D11_{X,Y}=L11_{X,Y}(D11_{X-1,Y}+D11_{X+1,Y});$$

wherein $D11_{X,Y}$ represents display data corresponding to one of the pixel groups in the first row group, $L11_{X,Y}$ represents a weighting parameter corresponding to the pixel group corresponding to the display data $D11_{X,Y}$, $D11_{X-1,Y}$ represents display data corresponding to an upper row of pixel group adjacent to the one pixel group corresponding to the display data $D11_{X,Y}$, and $D11_{X+1,Y}$ represents display data corresponding to a lower row of pixel group adjacent to the one pixel group corresponding to the display data $D11_{X,Y}$.

According to the driving apparatus of the display panel provided by the embodiment of the present disclosure, the display panel includes a plurality of rows of pixels; the plurality of rows of pixels are divided into N row groups, and each of the row groups includes pixels spaced by N−1 rows; N is an integer greater than 1; and the driving apparatus includes:

a data obtaining circuit, configured to obtain image data of a plurality of continuous display frames to be displayed, wherein image data of each of the display frames include display data corresponding to each of the pixels; and a data transmission circuit, configured to, in the condition that the display panel is driven to display a $(2k-1)^{th}$ image, transmit display data, corresponding to pixels of one of the row groups, in the image data of a $k^{th}$ display frame of the plurality of display frames to a driver chip in the display panel, so that the driver chip in the display panel drives the display panel to display an image according to the received display data; and in the condition that the display panel is driven to display a $(2k)^{th}$ image, transmit display data, corresponding to pixels of another of the row groups, in the image data of the $k^{th}$ display frame to the driver chip in the display panel, so that the driver chip in the display panel drives the display panel to display an image according to the received display data, where k is an integer greater than 0.

An embodiment of the present disclosure provides a display apparatus, including: a display panel and the above driving apparatus.

An embodiment of the present disclosure provides a non-transitory computer-readable storage medium, wherein the non-transitory computer-readable storage medium stores a computer program, and the computer program causes a processer to perform the abovementioned driving method of the display panel when the computer program is executed by the processor.

An embodiment of the present disclosure provides a computer device, comprising a memory, a processor and a computer program which is stored on the memory and capable of running on the processor, wherein the processor executes the computer program to perform the above driving method of the display panel.

DETAILED DESCRIPTION OF THE EMBODIMENTS

Figure 1:
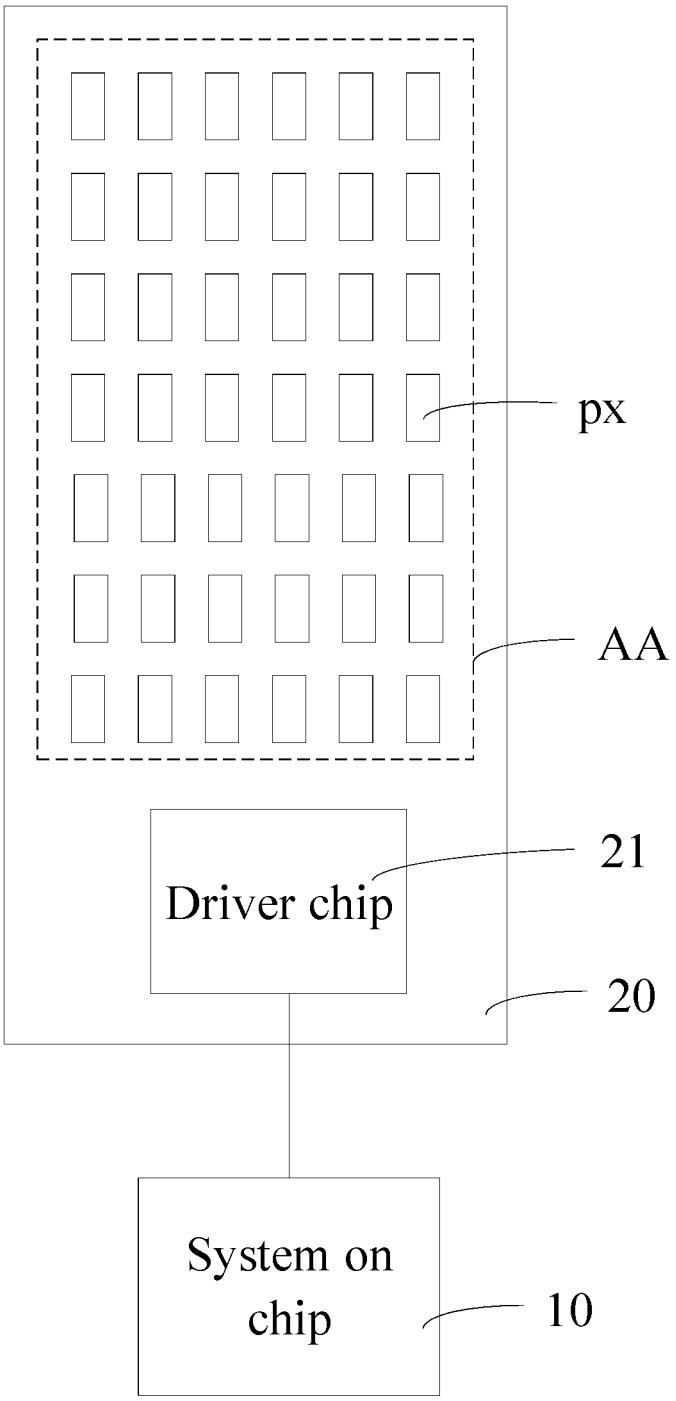
FIG. 1 is a schematic structural diagram of a display apparatus in an embodiment of the present disclosure.

In order to make the objectives, technical solutions, and advantages of the embodiments of the present disclosure clearer, the technical solutions of the embodiments of the present disclosure will be described clearly and completely in conjunction with the accompanying drawings of the embodiments of the present disclosure. Obviously, the described embodiments are a part of the embodiments of the present disclosure, rather than all of the embodiments. In the case of no conflict, the embodiments of the present disclosure and the features in the embodiments may be combined with each other. Based on the described embodiments of the present disclosure, all other embodiments obtained by those of ordinary skill in the art without creative work shall fall within the protection scope of the present disclosure.

Unless otherwise defined, the technical or scientific terms used in the present disclosure shall have the common meanings understood by those of ordinary skill in the field to which the present disclosure belongs. "First", "second" and similar words used in the present disclosure do not indicate any order, quantity or importance, but are only used to distinguish different components. "Include" or "comprise" and other similar words mean that an element or item appearing before the word covers elements or items listed after the word and their equivalents, but does not exclude other elements or items. Similar words such as "connected" or "linked" are not limited to physical or mechanical connections, but may include electrical connections, whether direct or indirect.

It should be noted that the size and shape of each figure in the drawings do not reflect the true ratio, and is only to illustrate the content of the present disclosure. Same or similar reference numerals indicate same or similar elements or elements with same or similar functions.

As shown in FIG. 1, a display apparatus is provided with a system on chip (SOC) 10 and a display panel 20, and the display panel is generally provided with a driver chip 21. Moreover, a display region AA of the display panel includes a plurality of pixels PX arranged in an array mode, i.e. the pixels PX are repeatedly arranged in the display region AA in a row direction and a column direction. In some embodiments, each pixel PX includes a plurality of sub-pixels. In some embodiments, the pixel PX may include red sub-pixels, green sub-pixels, and blue sub-pixels. In this way, red, green and blue may be mixed to achieve color display. Alternatively, the pixel may also include red sub-pixels, green sub-pixels, blue sub-pixels, and white sub-pixels. In this way, red, green, blue and white may be mixed to achieve color display. Of course, in practical application, a light-emitting color of the sub-pixels in the pixel may be designed and determined according to an actual application environment, which is not limited here.

In some embodiments, the display panel may be a liquid crystal display panel or an electroluminescent display panel. The electroluminescent display panel may be an organic light emitting diode display panel or a quantum dot light emitting diode display panel, which is not limited here.

In practical application, the system on chip obtains a video, the video is provided with image data of a plurality of continuous display frames, and the image data of each display frame may control the display panel to display an image. In practical application, when the display panel is controlled to display the image, the system on chip needs to transmit all the image data of the display frame to the driver chip in the display panel, so that the driver chip drives the display panel to display the image according to the image data transmitted by the system on chip. However, as a resolution of the display panel becomes higher and higher, a required refresh frequency is also higher and higher, which leads to an increasingly large amount of image data of one display frame transmitted by the system on chip to the driver chip. As a result, a data transmission size of the system on chip is increased, and requirements for a data transmission rate are becoming higher and higher. When the transmission rate of the system on chip does not meet the requirements, it will cause a phenomenon of lagging of images displayed by the display panel.

Figure 2:
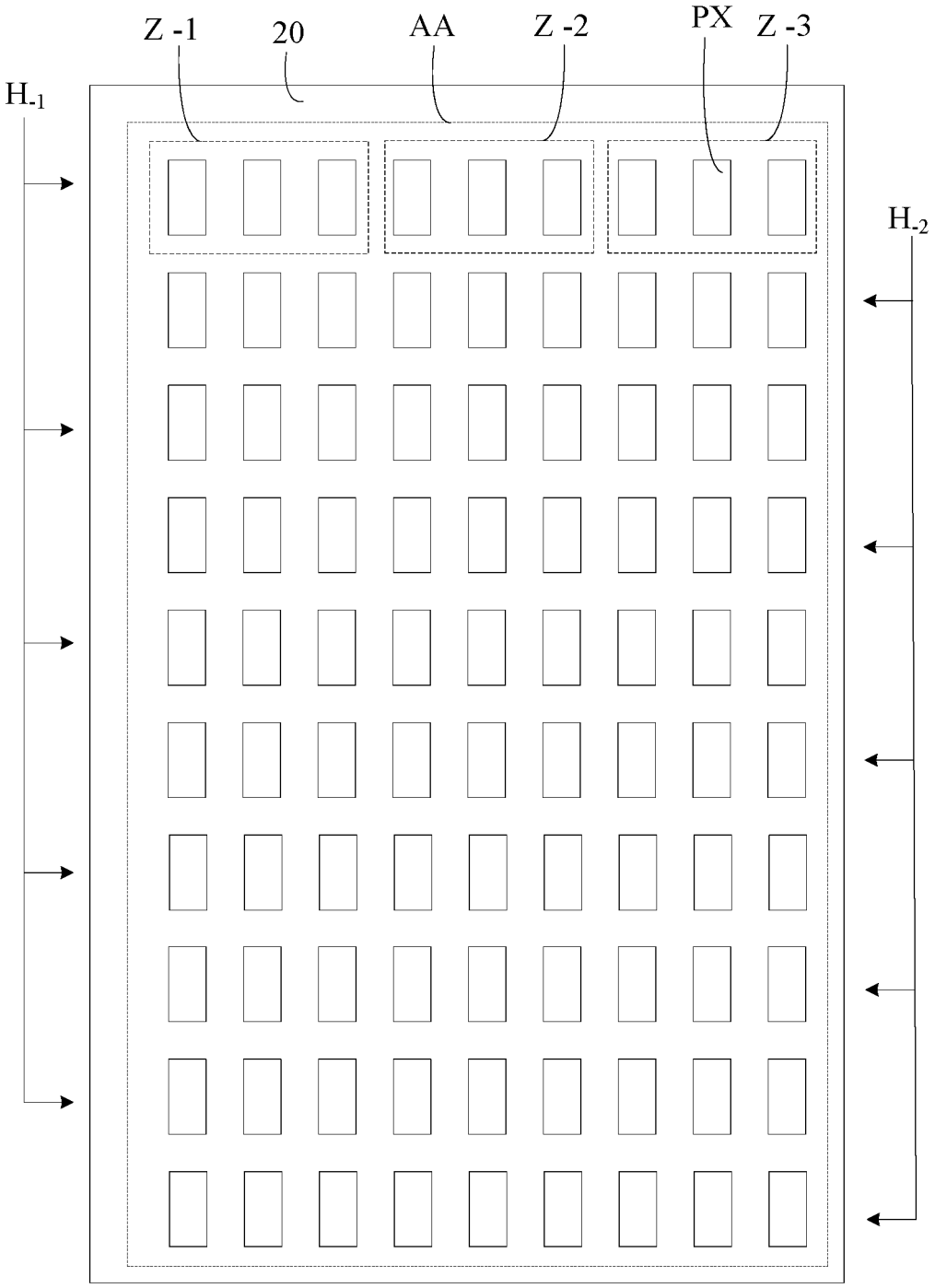
FIG. 2 is a schematic structural diagram of a display panel in an embodiment of the present disclosure.

In the embodiment of the present disclosure, the display panel includes a plurality of rows of pixels; the plurality of rows of pixels are divided into N row groups $H_{-n}$, ($1 \leq (1$, n is an integer, and N is an integer greater than 1), and each row group includes pixels spaced by N−1 rows. In some embodiments, as shown in FIG. 2, N may be equal to 2, so that the plurality of rows of pixels may be divided into 2 row groups, and these 2 row groups may include a first row group $H_{-1}$ and a second row group $H_{-2}$. The first row group $H_{-1}$ includes odd-numbered rows of pixels, and the second row group $H_{-2}$ includes even-numbered rows of pixels. Alternatively, N may be equal to 3, so that the plurality of rows of pixels may be divided into 3 row groups, and these 3 row groups may include a first row group $H_{-1}$, a second row group $H_{-2}$, and a third row group $H_{-3}$. The first row group $H_{-1}$ includes $(3Y-2)^{th}$ row of pixels, the second row group $H_{-2}$ includes $(3Y-1)^{th}$ row of pixels, and the third row group $H_{-3}$ includes $(3Y)^{th}$ row of pixels. Alternatively, N may be equal to 4, so that the plurality of rows of pixels may be divided into 4 row groups, and these 4 row groups may include a first row group $H_{-1}$, a second row group $H_{-2}$, a third row group $H_{-3}$ and a fourth row group $H_{-4}$. The first row group $H_{-1}$ includes $(4Y-3)^{th}$ row of pixels, the second row group $H_{-2}$ includes $(4Y-2)^{th}$ row of pixels, the third row group $H_{-3}$ includes $(4Y-1)^{th}$ row of pixels, the fourth row group $H_{-4}$ includes $(4Y)^{th}$ row of pixels, wherein Y is an integer greater than 0, and H represents a reference sign. In actual application, a specific value of N may be determined by design according to actual application requirements, which is not limited here.

Figure 3:
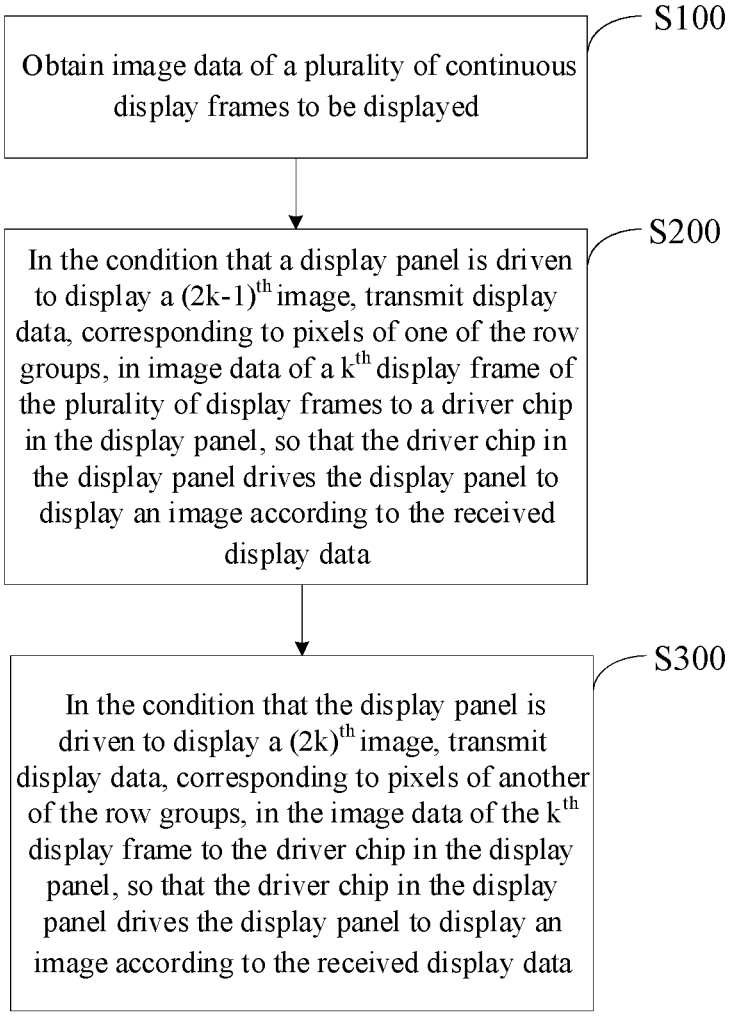
FIG. 3 is a flow chart of a display method in an embodiment of the present disclosure.

A driving method provided by an embodiment of the present disclosure, as shown in FIG. 3, may include the following steps.

S100, image data of a plurality of continuous display frames to be displayed are obtained, wherein image data of each display frame include display data corresponding to each pixel.

S200, in a condition that a display panel is driven to display a $(2k-1)^{th}$ image, display data, corresponding to pixels of one row group, in the image data of a $k^{th}$ display frame of the plurality of display frames are transmitted to a driver chip in the display panel, so that the driver chip in the display panel drives the display panel to display an image according to the received display data, where k is an integer greater than 0.

S300, in a condition that the display panel is driven to display a $(2k)^{th}$ image, display data, corresponding to pixels of another row group, in the image data of the $k^{th}$ display frame are transmitted to the driver chip in the display panel, so that the driver chip in the display panel drives the display panel to display an image according to the received display data.

According to the driving method provided by the embodiment of the present disclosure, in the condition that the display panel is driven to display a $(2k-1)^{th}$ image, only display data, corresponding to pixels of one row group, in image data of a $k^{th}$ display frame of a plurality of display frames are transmitted to the driver chip in the display panel, and a data size transmitted may be reduced. In the condition that the display panel is driven to display a $(2k)^{th}$ image, display data, corresponding to pixels of another row group, in the image data of the $k^{th}$ display frame are transmitted to the driver chip in the display panel, and the data size transmitted may be reduced. In this way, when a system on chip transmits the display data to the driver chip in the display panel, the data size transmitted to the driver chip in the display panel may be reduced, so that when a transmission rate of the system on chip fails to reach a requirement, a phenomenon of lagging of images displayed by the display panel may be improved.

It needs to be noted that, a sequence of step S200 and step S300 may be determined according to an order in which the display panel is driven to display a certain image.

Take N=2 as an example for the following explanation.

In the embodiment of the present disclosure, in the condition that the display panel is driven to display the $(2k-1)^{th}$ image, the display data, corresponding to the pixels of one row group, in the image data of the $k^{th}$ display frame of the plurality of display frames are transmitted to the driver chip in the display panel by the following step. In the condition that the display panel is driven to display the $(2k-1)^{th}$ image, display data, corresponding to pixels of the first row group, in the image data of the $k^{th}$ display frame are transmitted to the driver chip in the display panel.

In some embodiments, in the condition that the display panel is driven to display a first image, display data of pixels of the first row group corresponding to image data of a first display frame are transmitted to the driver chip in the display panel. That is, in the condition that the display panel is driven to display the first image, display data, corresponding to pixels of the odd-numbered rows, in image data of the first display frame are transmitted to the driver chip in the display panel.

In the condition that the display panel is driven to display a third image, display data of pixels of the first row group corresponding to image data of a second display frame are transmitted to the driver chip in the display panel. That is, in the condition that the display panel is driven to display the third image, display data, corresponding to pixels of the odd-numbered rows, in image data of the second display frame are transmitted to the driver chip in the display panel.

In the condition that the display panel is driven to display a fifth image, display data of pixels of the first row group corresponding to image data of a third display frame are transmitted to the driver chip in the display panel. That is, in the condition that the display panel is driven to display the fifth image, display data, corresponding to pixels of the odd-numbered rows, in image data of the third display frame are transmitted to the driver chip in the display panel.

In the embodiment of the present disclosure, in the condition that the display panel is driven to display the $(2k-1)^{th}$ image, the display data, corresponding to the pixels of one row group, in the image data of the $k^{th}$ display frame of the plurality of display frames are transmitted to the driver chip in the display panel by the following step. In the condition that the display panel is driven to display the $(2k-1)^{th}$ image, display data, corresponding to pixels of the second row group, in the image data of the $k^{th}$ display frame are transmitted to the driver chip in the display panel.

In some embodiments, in the condition that the display panel is driven to display a first image, display data of pixels of the second row group corresponding to image data of a first display frame are transmitted to the driver chip in the display panel. That is, in the condition that the display panel is driven to display the first image, display data, corresponding to pixels of the odd-numbered rows, in image data of the first display frame are transmitted to the driver chip in the display panel.

In the condition that the display panel is driven to display a third image, display data of pixels of the second row group corresponding to image data of a second display frame are transmitted to the driver chip in the display panel. That is, in the condition that the display panel is driven to display the third image, display data, corresponding to pixels of the odd-numbered rows, in image data of the second display frame are transmitted to the driver chip in the display panel.

In the condition that the display panel is driven to display a fifth image, display data of pixels of a second row group corresponding to image data of a third display frame are transmitted to the driver chip in the display panel. That is, in the condition that the display panel is driven to display the fifth image, display data, corresponding to pixels of the odd-numbered rows, in image data of the third display frame are transmitted to the driver chip in the display panel.

In the embodiment of the present disclosure, in the condition that the display panel is driven to display the $(2k)^{th}$ image, the display data, corresponding to the pixels of another row group, in the image data of $k^{th}$ display frame are transmitted to the driver chip in the display panel by the following step. In the condition that the display panel is driven to display the $(2k)^{th}$ image, display data, corresponding to pixels of the second row group, in the image data of the $k^{th}$ display frame are transmitted to the driver chip in the display panel.

In some embodiments, in the condition that the display panel is driven to display a second image, display data of pixels of a second row group corresponding to image data of a first display frame are transmitted to the driver chip in the display panel. That is, in the condition that the display panel is driven to display the second image, display data, corresponding to pixels of even-numbered rows, in image data of the first display frame are transmitted to the driver chip in the display panel.

In the condition that the display panel is driven to display a fourth image, display data of pixels of a second row group corresponding to image data of a second display frame are transmitted to the driver chip in the display panel. That is, in the condition that the display panel is driven to display the fourth image, display data, corresponding to pixels of even-numbered rows, in image data of the second display frame are transmitted to the driver chip in the display panel.

In the condition that the display panel is driven to display a sixth image, display data of pixels of a second row group corresponding to image data of a third display frame are transmitted to the driver chip in the display panel. That is, in the condition that the display panel is driven to display the sixth image, display data, corresponding to pixels of even-numbered rows, in image data of the third display frame are transmitted to the driver chip in the display panel.

In the condition that the display panel is driven to display the $(2k)^{th}$ image, the display data, corresponding to the pixels of another row group, in the image data of $k^{th}$ display frame are transmitted to the driver chip in the display panel by the following step. In the condition that the display panel is driven to display the $(2k)^{th}$ image, display data, corresponding to pixels of the first row group, in the image data of the $k^{th}$ display frame are transmitted to the driver chip in the display panel.

In some embodiments, in the condition that the display panel is driven to display a second image, display data of pixels of a first row group corresponding to image data of a first display frame are transmitted to the driver chip in the display panel. That is, in the condition that the display panel is driven to display the second image, display data, corresponding to pixels of even-numbered rows, in image data of the first display frame are transmitted to the driver chip in the display panel.

In the condition that the display panel is driven to display a fourth image, display data of pixels of a first row group corresponding to image data of a second display frame are transmitted to the driver chip in the display panel. That is, in the condition that the display panel is driven to display the fourth image, display data, corresponding to pixels of even-numbered rows, in image data of the second display frame are transmitted to the driver chip in the display panel.

In the condition that the display panel is driven to display a sixth image, display data of pixels of a first row group corresponding to image data of a third display frame are transmitted to the driver chip in the display panel. That is, in the condition that the display panel is driven to display the sixth image, display data, corresponding to pixels of even-numbered rows, in image data of the third display frame are transmitted to the driver chip in the display panel.

In some embodiments, a row of pixels is divided into a plurality of pixel groups, and each pixel group includes at least one pixel. Different pixel groups include different pixels. In addition, the quantity of pixel groups divided in the respective rows of pixels is also identical. In some embodiments, each pixel group includes a plurality of pixels adjacent to each other. In some embodiments, the quantity of pixels included in the respective pixel groups may be identical. Of course, the quantity of pixels included in different pixel groups may also be different, which is not limited here.

In some embodiments, as shown in FIG. 2, one row of pixels is divided into 3 pixel groups: a pixel group Z-1, a pixel group Z-2, and a pixel group Z-3. In addition, the pixel group Z-1, the pixel group Z-2, and the pixel group Z-3 each includes the same quantity of pixels. Of course, the quantity of pixel groups included in one row of pixels may be 5, 10, 20, etc., which may be designed and determined according to actual application requirements, which is not limited here.

In the embodiment of the present disclosure, in the condition that the display data of pixels of the second row group corresponding to image data of the $k^{th}$ display frame are transmitted to the driver chip in the display panel, the driver chip in the display panel driving the display panel to display an image according to the received display data by the following step. The driver chip, according to the received display data, determines display data corresponding to each pixel group in the first row group as data obtained by weighting display data corresponding to an upper row of pixel group and display data corresponding to a lower row of pixel group adjacent to the pixel group in the first row group.

In some embodiments, the display data corresponding to each pixel group in the first row group are determined as the data obtained by weighting the display data corresponding to the upper row of pixel group and the display data corresponding to the lower row of pixel group adjacent to the pixel group in the first row group according to a formula as follows:

$$D11_{X,Y}=L11_{X,Y}(D11_{X-1,Y}+D11_{X+1,Y}).$$

Wherein $D11_{X,Y}$ represents display data corresponding to one pixel group in the first row group, $L11_{X,Y}$ represents a weighting parameter corresponding to this pixel group corresponding to the display data $D11_{X,Y}$, $D11_{X-1,Y}$ represents display data corresponding to an upper row of pixel group adjacent to this pixel group corresponding to the display data $D11_{X,Y}$, and $D11_{X+1,Y}$ represents display data corresponding to a lower row of pixel group adjacent to this one pixel group corresponding to the display data $D11_{X,Y}$.

In the embodiment of the present disclosure, in the condition that the display data of pixels of the first row group corresponding to image data of the $k^{th}$ display frame is transmitted to the driver chip in the display panel, the driver chip in the display panel driving the display panel to display an image according to the received display data by the following step. The driver chip, according to the received display data, determines display data corresponding to each pixel group in the second row group as data obtained by weighting display data corresponding to an upper row of pixel group and display data corresponding to a lower row of pixel group adjacent to the pixel group in the second row group.

In some embodiments, the display data corresponding to each pixel group in the second row group are determined as the data obtained by weighting the display data corresponding to the upper row of pixel group and the display data corresponding to the lower row of pixel group adjacent to the pixel group in the second row group according to a formula as follows: $D12_{X,Y}=L12_{X,Y}(D12_{X-1,Y}+D12_{X+1,Y})$.

$D12_{X,Y}$ represents display data corresponding to one pixel group in the second row group, $L12_{X,Y}$ represents a weighting parameter corresponding to this pixel group corresponding to the display data $D12_{X,Y}$, $D12_{X-1,Y}$ represents display data corresponding to an upper row of pixel group adjacent to this pixel group corresponding to the display data $D12_{X,Y}$, and $D12_{X+1,Y}$ represents display data corresponding to a lower row of pixel group adjacent to this pixel group corresponding to the display data $D12_{X,Y}$.

In conjunction with specific embodiments, the same quantity of pixels included in each pixel group is taken as an example, and the present disclosure will be described in detail. It should be noted that the purpose of the embodiment is to better explain the present disclosure, but does not limit the present disclosure.

In some examples, the driving method provided by the embodiment of the present disclosure includes the following steps.

(1) image data of a plurality of continuous display frames to be displayed are obtained.

In some embodiments, image data of each display frame include display data corresponding to each pixel. Since each pixel includes a plurality of sub-pixels, the display data of the pixel may include display data corresponding to each sub-pixel in the pixel.

A gray scale generally is that a brightness change range between the darkest and the brightest is divided into several parts to facilitate screen brightness control. For example, a displayed image may generally be composed of three colors of red, green, and blue to form a color image by mixing. Each color may show a different brightness level, and different brightness levels of red, green, and blue may be combined to form different color points. The gray scale represents a gradation level of different brightness from the darkest to the brightest. The more intermediate levels there are, the more delicate the image that may be presented is. Generally, a 6 bit ($2^6$ brightness levels, that is, with 64 gray scales) panel, a 7 bit ($2^7$ brightness levels, that is, with 128 gray scales) panel, a 8 bit ($2^8$ brightness levels, that is, with 256 gray scales) panel, a 10 bit ($2^{10}$ brightness levels, that is, with 1024 gray scales) panel, a 12 bit ($2^{12}$ brightness levels, that is, with 4096 gray scales) panel or a 16 bit ($2^{16}$ brightness levels, that is, with 65536 gray scales) panel may be adopted to achieve image display.

In some embodiments, the display data corresponding to the sub-pixel may be gray-scale data corresponding to a brightness of a gray scale to be displayed by the sub-pixel.

(2) In the condition that the display panel is driven to display a first image, display data, corresponding to pixels of a first row group, in image data of a first display frame are transmitted to the driver chip in the display panel. That is, in the condition that the display panel is driven to display the first image, display data, corresponding to pixels of odd-numbered rows, in image data of the first display frame are transmitted to the driver chip in the display panel.

(3) The driver chip, according to the received display data, adopts the following formula to determine the display data corresponding to each pixel group in the second row group as the data obtained by weighting the display data corresponding to the upper row of pixel group and the display data corresponding to the lower row of pixel group adjacent to each of the pixel groups in the second row group: $D12_{X,Y=L}12_{X,Y}(D12_{X-1,Y}+D12_{X+1,Y})$.

Wherein $D12_{X,Y}$ represents display data corresponding to one pixel group in the second row group, $L12_{X,Y}$ represents a weighting parameter corresponding to this pixel group corresponding to the display data $D12_{X,Y}$, $D12_{X-1,Y}$ represents display data corresponding to an upper row of pixel group adjacent to this pixel group corresponding to the display data $D12_{X,Y}$, and $D12_{X+1,Y}$ represents display data corresponding to a lower row of pixel group adjacent to this pixel group corresponding to the display data $D12_{X,Y}$.

In some embodiments, the pixel groups are in one-to-one correspondence with the weighting parameters. The weighting parameter may be determined according to test data, and the weighting parameter may be stored in advance.

In some embodiments, in one same column, the display data $D12_{X,Y}$ corresponding to one pixel group in the second row may be the data obtained by weighting the display data $D12_{X-1,Y}$ corresponding to one pixel group in the first row and the display data $D12_{X+1,Y}$ corresponding to one pixel group in the third row.

In one same column, the display data $D12_{X,Y}$ corresponding to one pixel group in a fourth row group may be the data obtained by weighting the display data $D12_{X-1,Y}$ corresponding to one pixel group in the third row and the display data $D12_{X+1,Y}$ corresponding to one pixel group in a fifth row.

Similarly, the rest may be analogized in the same principle, which will not be repeated here.

It should be noted that since no remaining pixels are arranged below a last row of pixels in the second row group, the display data corresponding to the last row of pixels in the second row group may not be determined, that is, the driver chip calculates the display data corresponding to a second last row of pixels in the second row group.

It should be noted that a general display panel will be provided with virtual pixels, that is, virtual pixels that are not used for display are arranged on the first row of pixels in a display region, and virtual pixels that are not used for display are arranged under the last row in the display region. The obtained display data of the plurality of display frames not only include display data corresponding to each pixel in the display region, but may also include display data corresponding to each virtual pixel. In this way, in one same column, the display data corresponding to the pixels in the last row of pixels in the second row group may be determined as data obtained by weighting display data corresponding to an upper row of pixels and a lower row of virtual pixels adjacent to the last row of pixels. For example, if the display panel includes 1000 rows of pixels, in one same column, display data corresponding to the $1000^{th}$ row of pixels may be determined as data obtained by weighting display data corresponding to the $999^{th}$ row of pixels and display data corresponding to a lower row of virtual pixels adjacent to the $1000^{th}$ row of pixels.

(4) The driver chip, according to the received display data corresponding to the first row group and the determined display data corresponding to the second row group, drives the display panel to display the first image.

(5) In the condition that the display panel is driven to display the second image, the display data, corresponding to pixels of the second row group, in image data of the first display frame are transmitted to the driver chip in the display panel. That is, in the condition that the display panel is driven to display the second image, the display data, corresponding to even-numbered rows of pixels, in the image data of the first display frame are transmitted to the driver chip in the display panel.

(6) The driver chip, according to the received display data, adopts the following formula to determine the display data corresponding to each pixel group in the first row group as the data obtained by weighting the display data corresponding to the upper row of pixel group and the display data corresponding to the lower row of pixel group adjacent to each pixel group in the first row group: $D11_{X,Y=L}11_{X,Y}(D11_{X-1,Y}+D11_{X+1,Y})$.

Wherein $D11_{X,Y}$ represents display data corresponding to one pixel group in the first row group, $L11_{X,Y}$ represents a weighting parameter corresponding to this pixel group corresponding to the display data $D11_{X,Y}$, $D11_{X-1,Y}$ represents display data corresponding to an upper row of pixel group adjacent to this pixel group corresponding to the display data $D11_{X,Y}$, and $D11_{X+1,Y}$ represents display data corresponding to a lower row of pixel group adjacent to this pixel group corresponding to the display data $D11_{X,Y}$.

In some embodiments, the pixel groups are in one-to-one correspondence with the weighting parameters. The weighting parameter may be determined according to test data, and the weighting parameter may be stored in advance.

In some embodiments, in one same column, the display data $D11_{X,Y}$ corresponding to a pixel group in the third row may be the data obtained by weighting the display data $D11_{X-1,Y}$ corresponding to a pixel group in the second row and the display data $D11_{X+1,Y}$ corresponding to a pixel group in the fourth row.

In one same column, the display data $D11_{X,Y}$ corresponding to one pixel group in a fifth row group may be the data obtained by weighting the display data $D11_{X-1,Y}$ corresponding to one pixel group in the fourth row and the display data $D11_{X+1,Y}$ corresponding to one pixel group in a sixth row.

Similarly, the rest may be analogized in the same principle, which will not be repeated here.

It should be noted that since no remaining pixels is arranged above the first row of pixels, the display data corresponding to the first row of pixels may not be determined, that is, the driver chip calculates the display data corresponding to the third row of pixels.

It should be noted that a general display panel will be provided with virtual pixels, that is, virtual pixels that are not used for display are arranged on the first row of pixels in a display region, and virtual pixels that are not used for display are arranged under the last row in the display region. The obtained display data of the plurality of display frames not only include display data corresponding to each pixel in the display region, but may also include display data corresponding to each virtual pixel. In this way, in one same column, the display data corresponding to the pixels in the first row of pixels may be determined as data obtained by weighting display data corresponding to an upper row of pixels and a lower row of virtual pixels adjacent to the first row of pixels. For example, if the display panel includes 1000 rows of pixels, in one same column, display data corresponding to the first row of pixels may be determined as data obtained by weighting display data corresponding to the upper row of pixels and display data corresponding to the lower row of virtual pixels adjacent to the first row of pixels.

(7) The driver chip, according to the received display data corresponding to the second row group and the determined display data corresponding to the first row group, drives the display panel to display the first image.

For a process of the display panel displaying other images, reference may be made to the abovementioned steps (2) to (7), which will not be repeated here.

Figure 4:
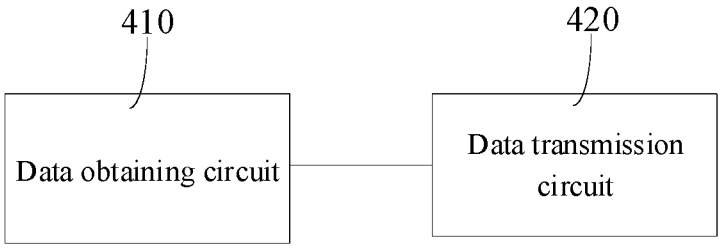
FIG. 4 is a schematic structural diagram of a driving apparatus in an embodiment of the present disclosure.

Based on the same inventive concept, an embodiment of the present disclosure further provides a driving apparatus of a display panel. As shown in FIG. 4, the driving apparatus may include:

a data obtaining circuit 410, configured to obtain image data of a plurality of continuous display frames to be displayed, wherein image data each of the display frames comprises display data corresponding to each pixel; and a data transmission circuit 420, configured to, in the condition that the display panel is driven to display a $(2k-1)^{th}$ image, transmit display data, corresponding to pixels of one row group, in the image data of a $k^{th}$ display frame of the plurality of display frames to a driver chip in the display panel, so that the driver chip in the display panel drives the display panel to display an image according to the received display data; and in the condition that the display panel is driven to display a $(2k)^{th}$ image, transmit display data, corresponding to pixels of another row group, in the image data of the $k^{th}$ display frame to the driver chip in the display panel, so that the driver chip in the display panel drives the display panel to display an image according to the received display data, wherein k is an integer greater than 0.

In some embodiments, the data obtaining circuit and the data transmission circuit in the embodiment of the present disclosure may adopt a form of a complete hardware embodiment, a complete software embodiment, or an embodiment combining software and hardware.

In some embodiments, the driving apparatus of the display panel in the embodiment of the present disclosure may be configured as a system on chip.

Based on the same inventive concept, an embodiment of the present disclosure further provides a liquid crystal display panel, including an opposite substrate and an array substrate which are arranged oppositely, and a liquid crystal layer located between the opposite substrate and the array substrate. The array substrate is any of the above-mentioned array substrates provided by the embodiment of the present disclosure. A principle of problem solving of the liquid crystal display panel is similar to that of the aforementioned array substrate. Therefore, for implementation of the liquid crystal display panel, reference may be made to implementation of the aforementioned array substrate, and the repetitive parts will not be repeated here.

Based on the same inventive concept, an embodiment of the present disclosure further provides a display apparatus, including the display panel provided by the embodiment of the present disclosure and the driving apparatus. A principle of problem solving of the display apparatus is similar to that of the aforementioned driving apparatus and driving method. Therefore, for implementation of the display apparatus, reference may be made to implementation of the aforementioned driving apparatus and driving method, and the repetitive parts will not be repeated here.

In the embodiment of the present disclosure, the display apparatus may be any product or component with a display function, such as a mobile phone, a tablet computer, a television, a displayer, a notebook computer, a digital photo frame, a navigator, and the like. Other indispensable components of the display apparatus are understood by those of ordinary skill in the art as provided, and will not be repeated here, nor should be used as a limitation to the present disclosure.

Based on the same inventive concept, an embodiment of the present disclosure further provides a non-transitory computer-readable storage medium, wherein the non-transitory computer-readable storage medium stores a computer program, and the computer program causes a processer to perform any driving method of the display panel provided by the embodiment of the present disclosure when the computer program is executed by the processor. In particular, the present disclosure may adopt a form of a computer program product implemented on one or more computer-usable storage media (including but not limited to disk storage, optical storage, etc.) containing computer-usable program codes.

Based on the same inventive concept, an embodiment of the present disclosure further provides a computer device, including a memory, a processor and a computer program which is stored on the memory and capable of running on the processor, wherein the processor executes the computer program to perform any driving method of the display panel provided by the embodiment of the present disclosure.

According to the driving method and apparatus of the display panel provided by the embodiment of the present disclosure, in the condition that the display panel is driven to display a $(2k-1)^{th}$ image, only display data, corresponding to pixels of one row group, in image data of the $k^{th}$ display frame of the plurality of display frames are transmitted to the driver chip in the display panel, and the data size transmitted may be reduced. In the condition that the display panel is driven to display the $(2k)^{th}$ image, display data, corresponding to pixels of another row group, in the image data of the $k^{th}$ display frame are transmitted to the driver chip in the display panel, and the data size transmitted may be reduced. In this way, in the condition that the system on chip transmits the display data to the driver chip in the display panel, the data size transmitted to the driver chip in the display panel may be reduced, so that when a transmission rate of the system on chip fails to reach a requirement, a phenomenon of lagging of images displayed by the display panel may be improved.

Apparently, those of skill in the art can make various changes and modifications to the present disclosure without departing from the spirit and scope of the present disclosure. In this way, if these modifications and variations of the present disclosure fall within the scope of the claims of the present disclosure and their equivalent technologies, the present disclosure is also intended to include these modifications and variations.

What is claimed is:

1. A driving method of a display panel, wherein the display panel comprises a plurality of rows of pixels; the plurality of rows of pixels are divided into N row groups, and each of the row groups comprises pixels spaced by N−1 rows; N is an integer greater than 1; and the driving method comprises:

obtaining image data of a plurality of continuous display frames to be displayed, wherein image data of each of the display frames comprises display data corresponding to each of the pixels;

in a condition that the display panel is driven to display a $(2k-1)^{th}$ image, transmitting display data, corresponding to pixels of one of the row groups, in the image data of a $k^{th}$ display frame of the plurality of display frames to a driver chip in the display panel, so that the driver chip in the display panel drives the display panel to display an image according to received display data, wherein k is an integer greater than 0; and in a condition that the display panel is driven to display a $(2k)^{th}$ image, transmitting display data, corresponding to pixels of another of the row groups, in the image data of the $k^{th}$ display frame to the driver chip in the display panel, so that the driver chip in the display panel drives the display panel to display an image according to the received display data;

wherein N=2, the 2 row groups comprise a first row group and a second row group, the first row group comprises odd-numbered rows of pixels, and the second row group comprises even-numbered rows of pixels; and in the condition that the display panel is driven to display the $(2k-1)^{th}$ image, transmitting the display data, corresponding to the pixels of one of the row groups, in the image data of the $k^{th}$ display frame of the plurality of display frames to the driver chip in the display panel comprises:

in the condition that the display panel is driven to display the $(2k-1)^{th}$ image, transmitting display data, corresponding to pixels of the first row group, in the image data of the $k^{th}$ display frame to the driver chip in the display panel; or in the condition that the display panel is driven to display the $(2k-1)^{th}$ image, transmitting display data, corresponding to pixels of the second row group, in the image data of the $k^{th}$ display frame to the driver chip in the display panel.

2. The driving method according to claim 1, wherein N=2, the 2 row groups comprise a first row group and a second row group, the first row group comprises odd-numbered rows of pixels and the second row group comprises even-numbered rows of pixels; and in the condition that the display panel is driven to display the $(2k)^{th}$ image, transmitting the display data, corresponding to the pixels of the another of the row groups, in the image data of the $k^{th}$ display frame to the driver chip in the display panel comprises:

in the condition that the display panel is driven to display the $(2k)^{th}$ image, transmitting display data, corresponding to pixels of the second row group, in the image data of the $k^{th}$ display frame to the driver chip in the display panel; or in the condition that the display panel is driven to display the $(2k)^{th}$ image, transmitting display data, corresponding to pixels of the first row group, in the image data of the $k^{th}$ display frame to the driver chip in the display panel.

3. The driving method according to claim 1, wherein one row of pixels is divided into a plurality of pixel groups, and each of the pixel groups comprises at least one pixel; and in the condition that the display data, corresponding to the pixels of the first row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the second row group as data obtained by weighting display data corresponding to an upper row of pixel group and display data corresponding to a lower row of pixel group adjacent to the respective pixel groups in the second row group.

4. The driving method according to claim 2, wherein one row of pixels is divided into a plurality of pixel groups, and each of the pixel groups comprises at least one pixel; and in the condition that the display data, corresponding to the pixels of the first row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the second row group as data obtained by weighting display data corresponding to an upper row of pixel group and display data corresponding to a lower row of pixel group adjacent to the respective pixel groups in the second row group.

5. The driving method according to claim 3, wherein the display data corresponding to the respective pixel groups in the second row group are determined as the data obtained by weighting the display data corresponding to the upper row of pixel group and the display data corresponding to the lower row of pixel group adjacent to the respective pixel groups in the second row group according to a formula as follows:

$$D12_{X,Y}=L12_{X,Y}(D12_{X-1,Y}+D12_{X+1,Y});$$

wherein $D12_{X,Y}$ represents display data corresponding to one of the pixel groups in the second row group, $L12_{X,Y}$ represents a weighting parameter corresponding to the one pixel group corresponding to the display data $D12_{X,Y}$, $D12_{X-1,Y}$ represents display data corresponding to an upper row of pixel group adjacent to the one pixel group corresponding to the display data $D12_{X,Y}$, and $D12_{X+1,Y}$ represents display data corresponding to a lower row of pixel group adjacent to the one pixel group corresponding to the display data $D12_{X,Y}$.

6. The driving method according to claim 4, wherein the display data corresponding to the respective pixel groups in the second row group are determined as the data obtained by weighting the display data corresponding to the upper row of pixel group and the display data corresponding to the lower row of pixel group adjacent to the respective pixel groups in the second row group according to a formula as follows:

$$D12_{X,Y}=L12_{X,Y}(D12_{X-1,Y}+D12_{X+1,Y});$$

wherein $D12_{X,Y}$ represents display data corresponding to one of the pixel groups in the second row group, $L12_{X,Y}$ represents a weighting parameter corresponding to the one pixel group corresponding to the display data $D12_{X,Y}$, $D12_{X-1,Y}$ represents display data corresponding to an upper row of pixel group adjacent to the one pixel group corresponding to the display data $D12_{X,Y}$, and $D12_{X+1,Y}$ represents display data corresponding to a lower row of pixel group adjacent to the one pixel group corresponding to the display data $D12_{X,Y}$.

7. The driving method according to claim 1, wherein one row of pixels is divided into a plurality of pixel groups, and each of the pixel groups comprises at least one pixel; and in the condition that the display data, corresponding to the pixels of the second row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the first row group as data obtained by weighting display data corresponding to an upper row of pixel group and display data corresponding to a lower row of pixel group adjacent to the respective pixel groups in the first row group.

8. The driving method according to claim 2, wherein one row of pixels is divided into a plurality of pixel groups, and each of the pixel groups comprises at least one pixel; and in the condition that the display data, corresponding to the pixels of the second row group, in the image data of the $k^{th}$ display frame are transmitted to the driver chip in the display panel, the driver chip in the display panel drives the display panel to display the image according to the received display data by: determining, by the driver chip, according to the received display data, display data corresponding to the respective pixel groups in the first row group as data obtained by weighting display data corresponding to an upper row of pixel group and display data corresponding to a lower row of pixel group adjacent to the respective pixel groups in the first row group.

9. The driving method according to claim 7, wherein the display data corresponding to the respective pixel groups in the first row group are determined as the data obtained by weighting the display data corresponding to the upper row of pixel group and the display data corresponding to the lower row of pixel group adjacent to the respective pixel groups in the first row group according to a formula as follows:

$$D11_{X,Y}=L11_{X,Y}(D11_{X-1,Y}+D11_{X+1,Y});$$

wherein $D11_{X,Y}$ represents display data corresponding to one of the pixel groups in the first row group, $L11_{X,Y}$ represents a weighting parameter corresponding to the one pixel group corresponding to the display data $D11_{X,Y}$, $D11_{X-1,Y}$ represents display data corresponding to an upper row of pixel group adjacent to the one pixel group corresponding to the display data $D11_{X,Y}$, and $D11_{X+1,Y}$ represents display data corresponding to a lower row of pixel group adjacent to the one pixel group corresponding to the display data $D11_{X,Y}$.

10. The driving method according to claim 8, wherein the display data corresponding to the respective pixel groups in the first row group are determined as the data obtained by weighting the display data corresponding to the upper row of pixel group and the display data corresponding to the lower row of pixel group adjacent to the respective pixel groups in the first row group according to a formula as follows:

$$D11_{X,Y}=L11_{X,Y}(D11_{X-1,Y}+D11_{X+1,Y});$$

wherein $D11_{X,Y}$ represents display data corresponding to one of the pixel groups in the first row group, $L11_{X,Y}$ represents a weighting parameter corresponding to the one pixel group corresponding to the display data $D11_{X,Y}$, $D11_{X-1,Y}$ represents display data corresponding to an upper row of pixel group adjacent to the one pixel group corresponding to the display data $D11_{X,Y}$, and $D11_{X+1,Y}$ represents display data corresponding to a lower row of pixel group adjacent to the one pixel group corresponding to the display data $D11_{X,Y}$.

11. A driving apparatus of a display panel, wherein the display panel comprises a plurality of rows of pixels; the plurality of rows of pixels are divided into N row groups, and each of the row groups comprises pixels spaced by N−1 rows; N is an integer greater than 1; and the driving apparatus comprises:

a data obtaining circuit, configured to obtain image data of a plurality of continuous display frames to be displayed, wherein image data of each of the display frames comprises display data corresponding to each of the pixels; and a data transmission circuit, configured to, in a condition that the display panel is driven to display a $(2k-1)^{th}$ image, transmit display data, corresponding to pixels of one of the row groups, in the image data of a $k^{th}$ display frame of the plurality of display frames to a driver chip in the display panel, so that the driver chip in the display panel drives the display panel to display an image according to a received display data; and in a condition that the display panel is driven to display a $(2k)^{th}$ image, transmit display data, corresponding to pixels of another of the row groups, in the image data of the $k^{th}$ display frame to the driver chip in the display panel, so that the driver chip in the display panel drives the display panel to display an image according to the received display data, wherein k is an integer greater than 0;

wherein when N=2, the 2 row groups comprise a first row group and a second row group, the first row group comprises odd-numbered rows of pixels, and the second row group comprises even-numbered rows of pixels; the data obtaining circuit is further configured to:

in the condition that the display panel is driven to display the $(2k-1)^{th}$ image, transmit display data, corresponding to pixels of the first row group, in the image data of the $k^{th}$ display frame to the driver chip in the display panel; or in the condition that the display panel is driven to display the $(2k-1)^{th}$ image, transmit display data, corresponding to pixels of the second row group, in the image data of the $k^{th}$ display frame to the driver chip in the display panel.

12. A display apparatus, wherein the display apparatus comprises: a display panel and a driving apparatus;

wherein the display panel comprises a plurality of rows of pixels; the plurality of rows of pixels are divided into N row groups, and each of the row groups comprises pixels spaced by N−1 rows; N is an integer greater than 1; and the driving apparatus comprises:

a data obtaining circuit, configured to obtain image data of a plurality of continuous display frames to be displayed, wherein image data of each of the display frames comprises display data corresponding to each of the pixels; and a data transmission circuit, configured to, in a condition that the display panel is driven to display a $(2k-1)^{th}$ image, transmit display data, corresponding to pixels of one of the row groups, in the image data of a $k^{th}$ display frame of the plurality of display frames to a driver chip in the display panel, so that the driver chip in the display panel drives the display panel to display an image according to a received display data; and in a condition that the display panel is driven to display a $(2k)^{th}$ image, transmit display data, corresponding to pixels of another of the row groups, in the image data of the $k^{th}$ display frame to the driver chip in the display panel, so that the driver chip in the display panel drives the display panel to display an image according to the received display data, wherein k is an integer greater than 0;

wherein when N=2, the 2 row groups comprise a first row group and a second row group, the first row group comprises odd-numbered rows of pixels, and the second row group comprises even-numbered rows of pixels; the data obtaining circuit is further configured to:

in the condition that the display panel is driven to display the $(2k-1)^{th}$ image, transmit display data, corresponding to pixels of the first row group, in the image data of the $k^{th}$ display frame to the driver chip in the display panel; or in the condition that the display panel is driven to display the $(2k-1)^{th}$ image, transmit display data, corresponding to pixels of the second row group, in the image data of the $k^{th}$ display frame to the driver chip in the display panel.

* * * * *